US006823855B2

(12) United States Patent
Omi

(10) Patent No.: US 6,823,855 B2
(45) Date of Patent: Nov. 30, 2004

(54) SLINGSHOT, SLINGSHOT RELEASER, AND RELEASER-INCORPORATED SLINGSHOT DEVICE

(75) Inventor: Shohei Omi, Anjo (JP)

(73) Assignee: Omi Kogyo Co., Ltd. (JP)

( * ) Notice: Subject to any disclaimer, the term of this patent is extended or adjusted under 35 U.S.C. 154(b) by 107 days.

(21) Appl. No.: 10/191,651

(22) Filed: Jul. 9, 2002

(65) Prior Publication Data

US 2003/0056775 A1 Mar. 27, 2003

(30) Foreign Application Priority Data

Aug. 22, 2001 (JP) ..... 2001-251297
Sep. 18, 2001 (JP) ..... 2001-283846

(51) Int. Cl.[7] ..... F41B 3/02
(52) U.S. Cl. ..... 124/20.1; 124/35.2
(58) Field of Search ..... 33/265; 124/20.1, 124/20.2, 20.3, 35.2

(56) References Cited

U.S. PATENT DOCUMENTS 2,501,568 A * 3/1950 Jarnagin
3,672,346 A * 6/1972 Plumb
4,784,106 A * 11/1988 Kees
5,431,145 A * 7/1995 Strait et al.
5,546,924 A * 8/1996 Todd
5,551,412 A * 9/1996 Warnke
5,762,056 A * 6/1998 Kysilka
5,894,672 A * 4/1999 Ellenburg et al.
6,564,787 B1 * 5/2003 Barry

* cited by examiner

*Primary Examiner*—John A. Ricci
(74) *Attorney, Agent, or Firm*—Akerman Senterfitt

(57) ABSTRACT

A slingshot device having an improved target hitting rate. The slingshot device includes a slingshot, which is provided with a front sight and a handgrip, and a releaser, which is provided with a rear sight. The releaser is used to stretch an elastic band of the slingshot. The drawing distance of the elastic band is adjusted by changing the position of the handgrip. The front sight is movable in directions that are perpendicular to the shooting direction of a pellet. The rear sight has a sight slit, which is used to determine the drawing direction of the elastic band.

20 Claims, 8 Drawing Sheets

H69
H64
H63
412
513
513
12b
12b
67
59
70
64
66
63
65
57a
62b
61
55
54
52
53
69
71
68
72
67
59
58
56
62a
60
50
51
51
50
49
57b
57a
50
51
49
51
50

SLINGSHOT, SLINGSHOT RELEASER, AND RELEASER-INCORPORATED SLINGSHOT DEVICE

BACKGROUND OF THE INVENTION

The present invention is related to a slingshot, a slingshot releaser, and a releaser-incorporated slingshot device.

In the prior art, to shoot a slingshot, a user sets a pellet in a pellet pouch, which is attached to an elastic band, such as a rubber tube. The user then draws the elastic band while holding the pellet pouch and takes aim at a target. Since the user relies only on his or her eyes when taking aim, the target hitting rate is low in the prior art.

SUMMARY OF THE INVENTION

It is an object of the present invention to provide a slingshot, a slingshot releaser, and a releaser-incorporated slingshot device that improves the target hitting rate.

To achieve the above object, the present invention provides a slingshot including an elastic band, which is used to shoot a pellet and has two ends, and a pouch, which is connected to the elastic band. The slingshot includes a main body. First and second connecting elements connect the two ends of the elastic band to the main body. The first and second connecting elements are separated from each other on the main body. The pellet is shot through a shooting space defined between the first and second connecting elements. A front sight is attached to the main body near one of the first and second connecting elements.

A further perspective of the present invention is a releaser of a slingshot. The slingshot includes an elastic band, which is used to shoot a pellet, and a pouch, which is connected to the elastic band. The releaser includes a clamp for holding the pouch. The clamp is selectively arranged at a closed position, in which the clamp holds the pouch, and an opened position, in which the clamp releases the pouch. A rear sight is arranged near the clamp.

A further perspective of the present invention is a slingshot device including a slingshot and a releaser. The slingshot includes a main body, an elastic band having two ends and connected to the main body to shoot a pellet, and a pouch connected to the elastic band. First and second connecting elements connect the two ends of the elastic band to the main body. The first and second connecting elements are separated from each other on the main body. The pellet is shot through a shooting space defined between the first and second connecting elements. A front sight is attached to the main body near one of the first and second connecting elements. A releaser stretches the elastic band. The releaser includes a clamp for holding the pouch. The clamp is selectively arranged at a closed position, in which the clamp holds the pouch, and an opened position, in which the clamp releases the pouch. A rear sight is arranged near the clamp.

A further perspective of the present invention is a slingshot including an elastic band, which is used to shoot a pellet and has two ends, and a pouch, which is connected to the elastic band. The slingshot includes a frame extending in a direction the pellet is shot and a front sight base attached to the frame. The front sight base is movable in a first direction, which is perpendicular to the frame. A front sight is attached to the front sight base. The front sight is movable in a second direction, which is perpendicular to the frame and to the first direction. Two brackets are fixed to the frame. Each of the two brackets supports one of the two ends of the elastic band. The two brackets are separated from each other in the first direction. First and second connecting elements are each fixed to one of the two brackets. The first and second connecting elements connect the ends of the elastic band to the two brackets. A handgrip is attached to the frame. The handgrip is moved along the frame to change the distance from the handgrip to the first and second connecting elements.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of a releaser-incorporated slingshot device 10 according to the present invention will now be discussed with reference to the drawings.

Figure 1:
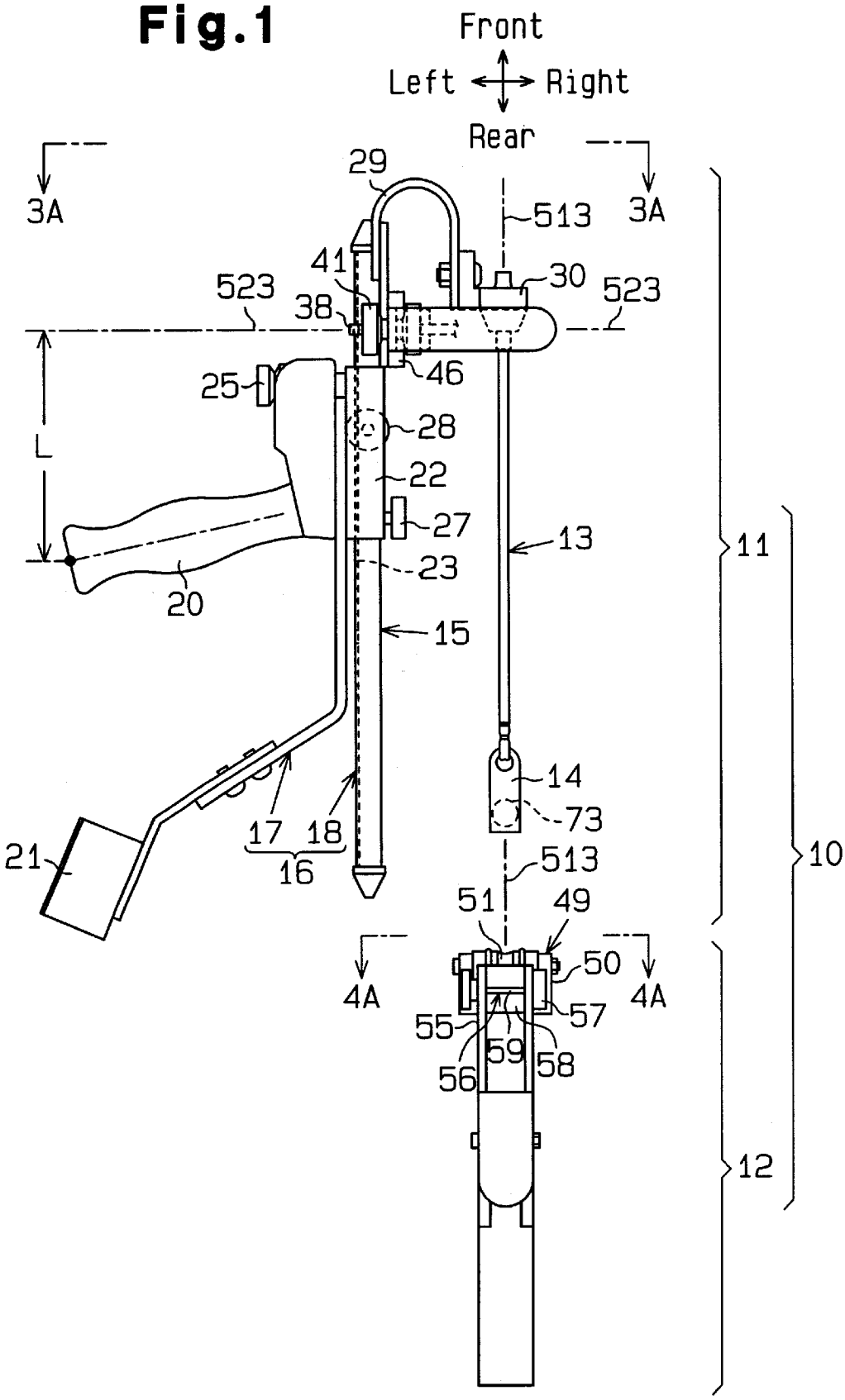
FIG. 1 is a plan view showing a releaser-incorporated slingshot device according to a first embodiment of the present invention.
Figure 2:
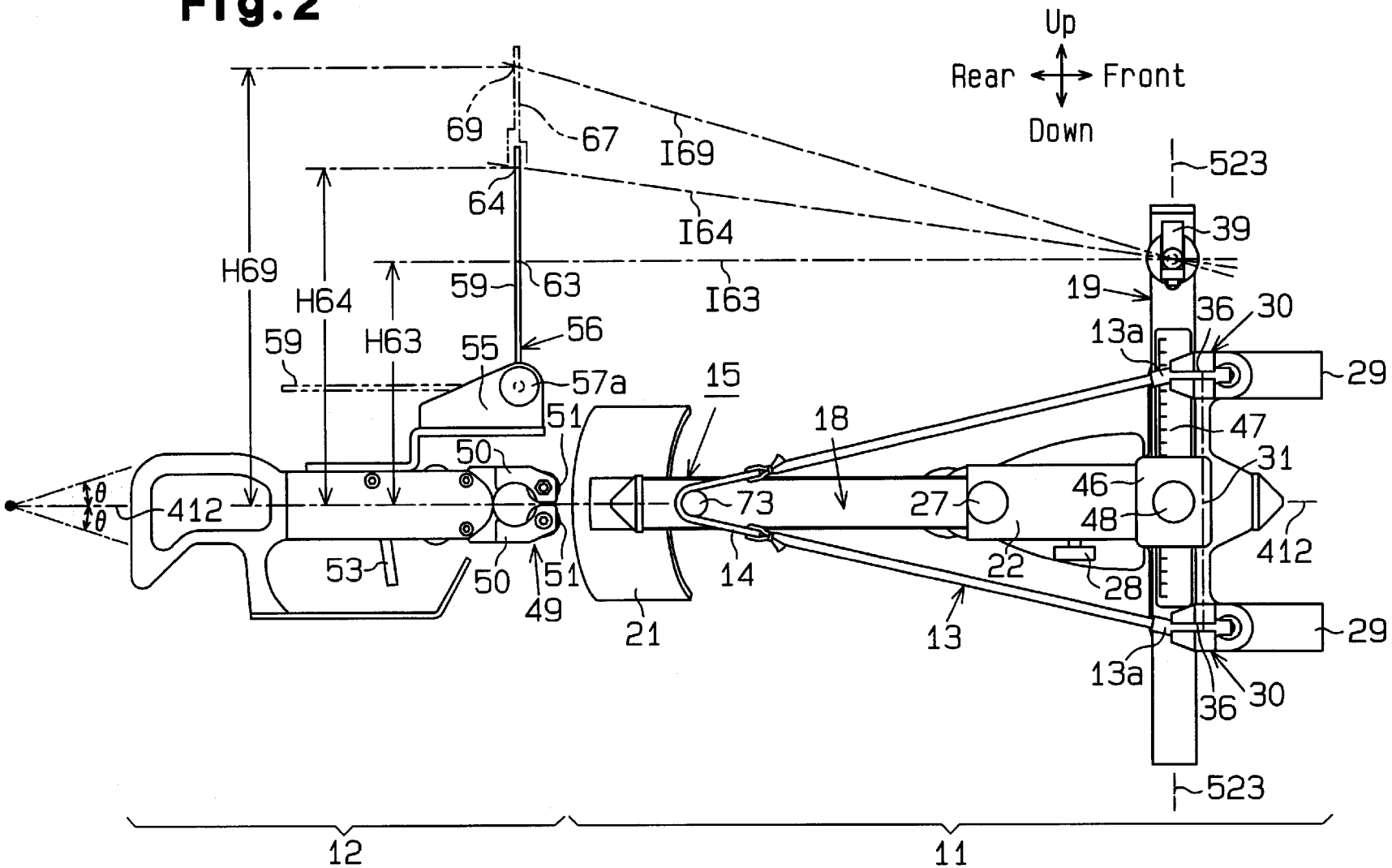
FIG. 2 is a side view showing the slingshot device of FIG. 2.

As shown in FIGS. 1 and 2, the releaser-incorporated slingshot device 10 includes a slingshot 11 and a releaser 12, which is arranged behind the slingshot 11 during usage. The user holds the slingshot 11 with one hand and holds the releaser 12 with the other hand. The slingshot 11 includes a main body 15, an elastic band (power band) 13, which is connected to the main body 15, and a pouch 14, which is attached to the elastic band 13. It is preferred that the elastic band 13 be a rubber tube and that the pouch 14 be made of natural leather or synthetic leather. The releaser 12 holds a pellet 73 and the pellet pouch 14. The main body 15 has a support frame 18 and a front sight base 19, which is supported by the support frame 18. As shown in FIG. 2, the front sight base 19 is attached to the support frame 18 at a right angle.

Figure 6A:
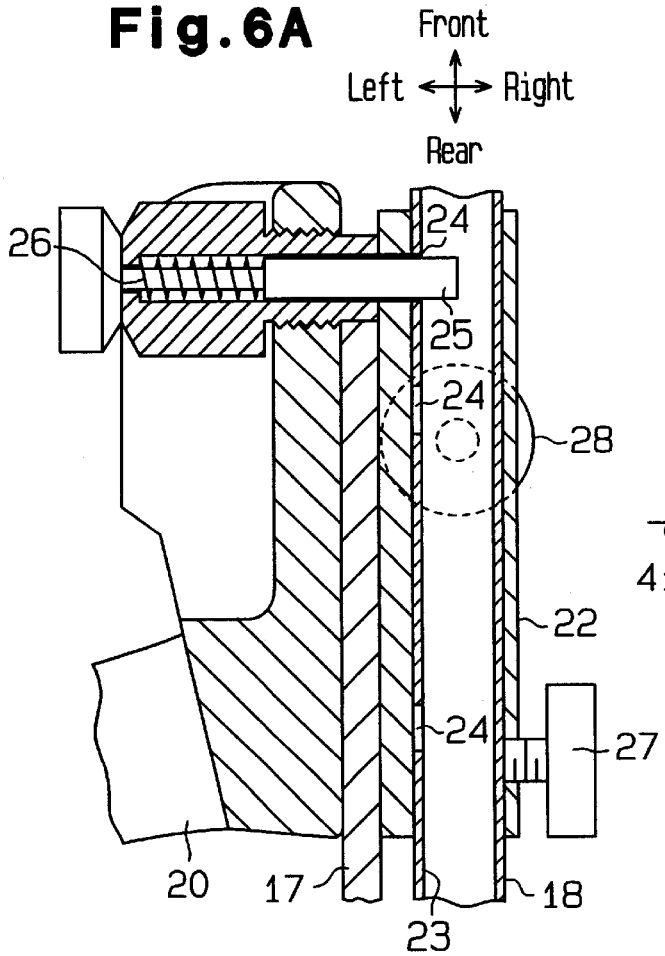
FIG. 6A is a partially enlarged cross-sectional view showing a handgrip of the slingshot of FIG. 1.

The support frame 18 supports an arm brace 17. A handgrip 20 is fixed to the front end of the arm brace 17. A semicylindrical armrest 21 is fixed to the rear end of the arm brace 17. The handgrip 20 and the armrest 21 are arranged on the left side of the arm brace 17, as viewed in FIG. 1. A guide sleeve 22 is attached to the arm brace 17. The support frame 18 is inserted through the guide sleeve 22. The guide sleeve 22 is axially movable along the support frame 18. As shown in FIG. 6A, the support frame 18 is hollow. The support frame 18 has a left wall 23, as viewed in FIG. 6A. The left wall 23 has a plurality of positioning holes 24 arranged in the longitudinal direction of the support frame 18. A positioning pin 25 is provided on the distal end of the arm brace 17. A compression coil spring 26 urges the positioning pin 25 so that the positioning pin 25 engages one of the positioning holes 24. The guide sleeve 22 has a right wall in which a fastening screw 27 is arranged and a bottom wall in which a fastening screw 28 is arranged, as viewed in FIG. 6A. When the fastening screws 27, 28 are fastened, the distal ends of the fastening screws 27, 28 are respectively abutted against the right wall and the bottom wall of the support frame 18. This fixes the guide sleeve 22 to the support frame 18. When the user loosens the fastening screws 27, 28 and pulls out the positioning pin 25 from the positioning hole 24 against the elastic force of the compression coil spring 26, the guide sleeve 22, together with the front sight base 19, may be moved along the support frame 18 to change the distance L between the handgrip 20 and the front sight base 19. After moving the guide sleeve 22 to obtain the desired distance L, the user engages the positioning pin 25 with the corresponding positioning hole 24 and fastens the fastening screws 27, 28 to position the guide sleeve 22 (i.e., handgrip 20) on the support frame 18.

Figure 3A:
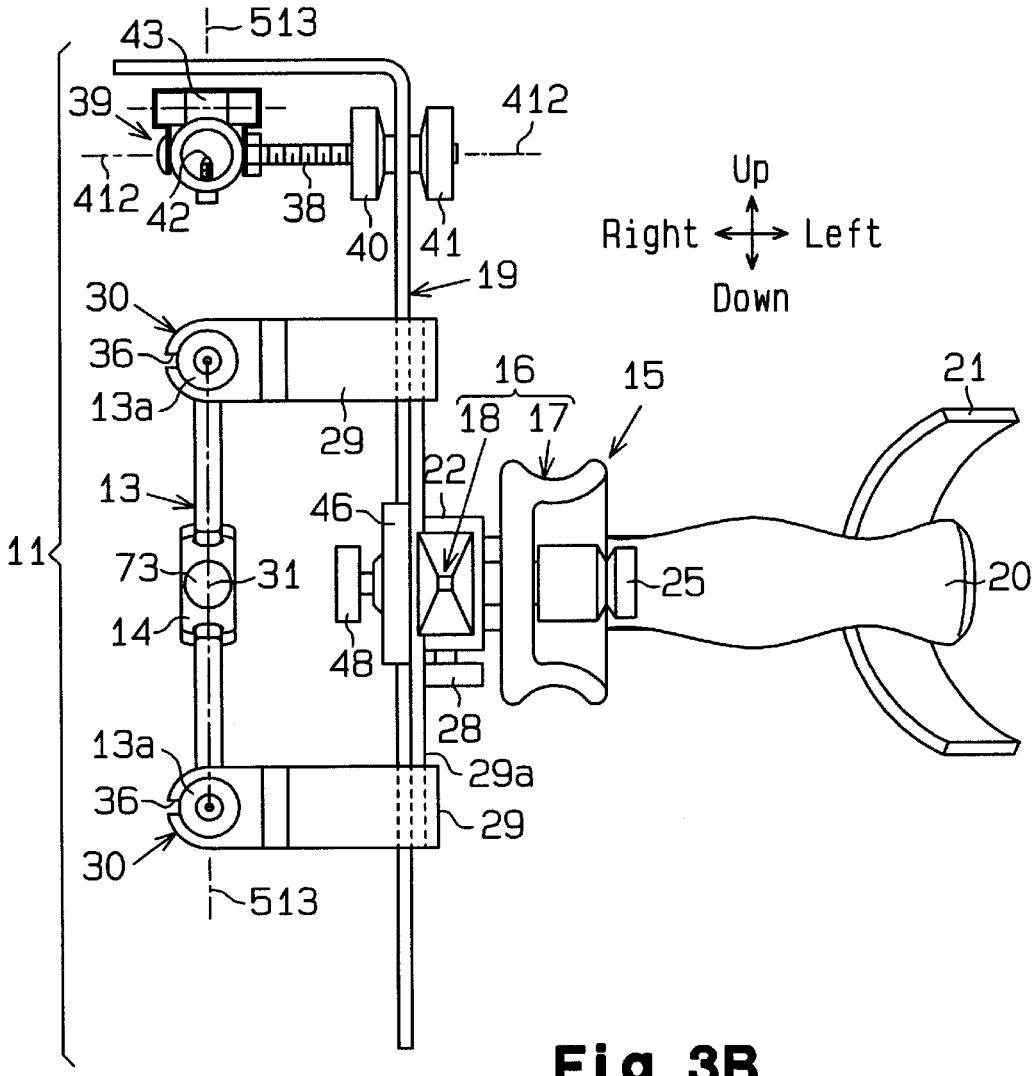
FIG. 3A is a front view of the slingshot taken from line 3A—3A of FIG. 1.
Figure 3B:
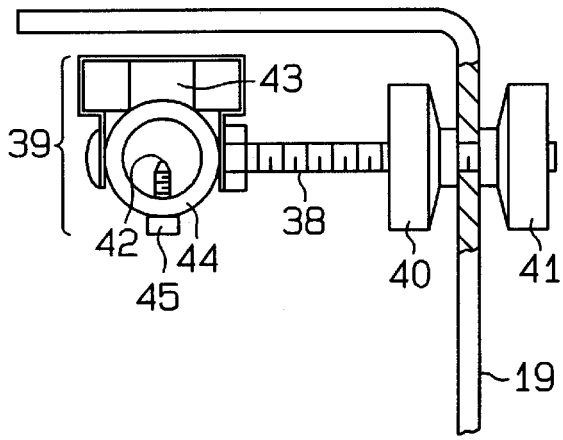
FIG. 3B is an enlarged view showing a front sight of FIG. 3A.

Referring to FIG. 3A, a connecting plate 29*a* is fixed to the front end of the support frame 18. The connecting plate 29*a* connects two U-shaped arms, or upper and lower anchor brackets 29. The upper anchor bracket 29 is located above the support frame 18, and the lower anchor bracket 29 is located below the support frame 18. A connecting element, or anchor connector 30, is attached to each anchor bracket 29. The anchor brackets 29 connect the elastic band 13 to the main body 15 (FIG. 1). Accordingly, the anchor brackets 29 and the connecting plates 29*a* support the anchor connectors 30 on the support frame 18.

Figure 7:
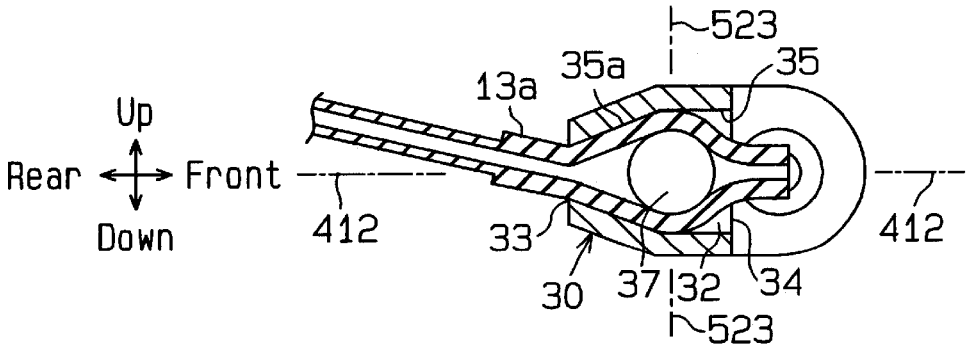
FIG. 7 is an enlarged cross-sectional view of an elastic band and an anchor connector.

FIG. 7 is a cross-sectional view of the lower anchor bracket 29 and the elastic band 13. The anchor connector 30 is hollow and has a cylindrical portion and a conical portion. The cylindrical portion has an inner cylindrical surface 35, and the conical portion has an inner conical surface (engaging surface) 35*a*. The surfaces 35, 35*a* define an engaging hole 32. The anchor connector 30 has a front opening (first opening) 34 and a rear opening (second opening) 33, which are connected by a slit 36 that extends through the side wall of the anchor connector 30 (FIG. 3A). The two ends 13*a* of the elastic band 13 are each connected to one of the two anchor connectors 30. More specifically, a ball 37 is inserted in each end 13*a* of the elastic band 13. The elastic band 13 extends through the rear openings 33 of the anchor connectors 30, and each end 13*a* of the elastic band 13 is held between the corresponding ball 37 and conical surface 35*a*. This prevents the elastic band 13 from falling out of the anchor connectors 30. The slits 36 facilitate the attachment of the elastic band 13 to the anchor connector 30. Referring to FIG. 7, it is preferred that the two ends 13*a* be relatively thick or that the two ends 13*a* each be folded in an overlapping manner. Since the portion of the elastic body 13 that contacts the walls of the rear openings 33 are relatively thick, the elastic band 13 is prevented from tearing and securely attached to the anchor connectors 30.

A pellet (ammo) 73 is shot through a shooting space 31 defined between the upper and lower anchor connectors 30.

Referring to FIG. 3A, a threaded shaft 38, which extends horizontally, is attached to the upper portion of the front sight base 19. The threaded shaft 38 has a basal end, which is engaged with nuts 40, 41. The position of the threaded shaft 38 relative to the front sight base 19 is determined by the nuts 40, 41. A front sight 39 is attached to the distal end of the threaded shaft 38. The front sight 39 is arranged at the outer side of the shooting space 31 and along a line connecting the upper and lower anchor connectors 30. The front sight 39 includes a ring 44, a sight point 42, and a level 43, which are used to take aim. In the preferred embodiment, the distal end of a threaded pin 45, which is engaged with the ring 44, is used as the sight point 42.

Figure 6B:
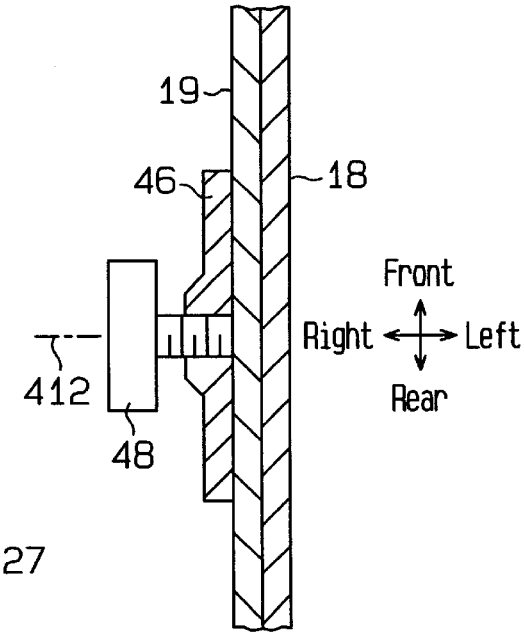
FIG. 6B is a partially cross-sectional view showing a front sight base and a positioning screw.

A guide sleeve 46 is fixed to the front end of the support frame 18. Referring to FIG. 6B, the guide sleeve 46 includes a positioning screw 48. When the positioning screw 48 is loosened, vertical movement of the front sight base 19 through the guide sleeve 46 is permitted. Further, in this state, the front sight base 19 may be removed from the guide sleeve 46. As shown in FIG. 2, a gauge 47 is provided on the right surface of the front sight base 19. The user refers to the gauge 47 to adjust the position of the front sight base 19 and fastens the positioning screw 48 to fix the front sight base 19 to the guide sleeve 46. This adjusts the height of the front sight 39.

Figures 4A, 4B:
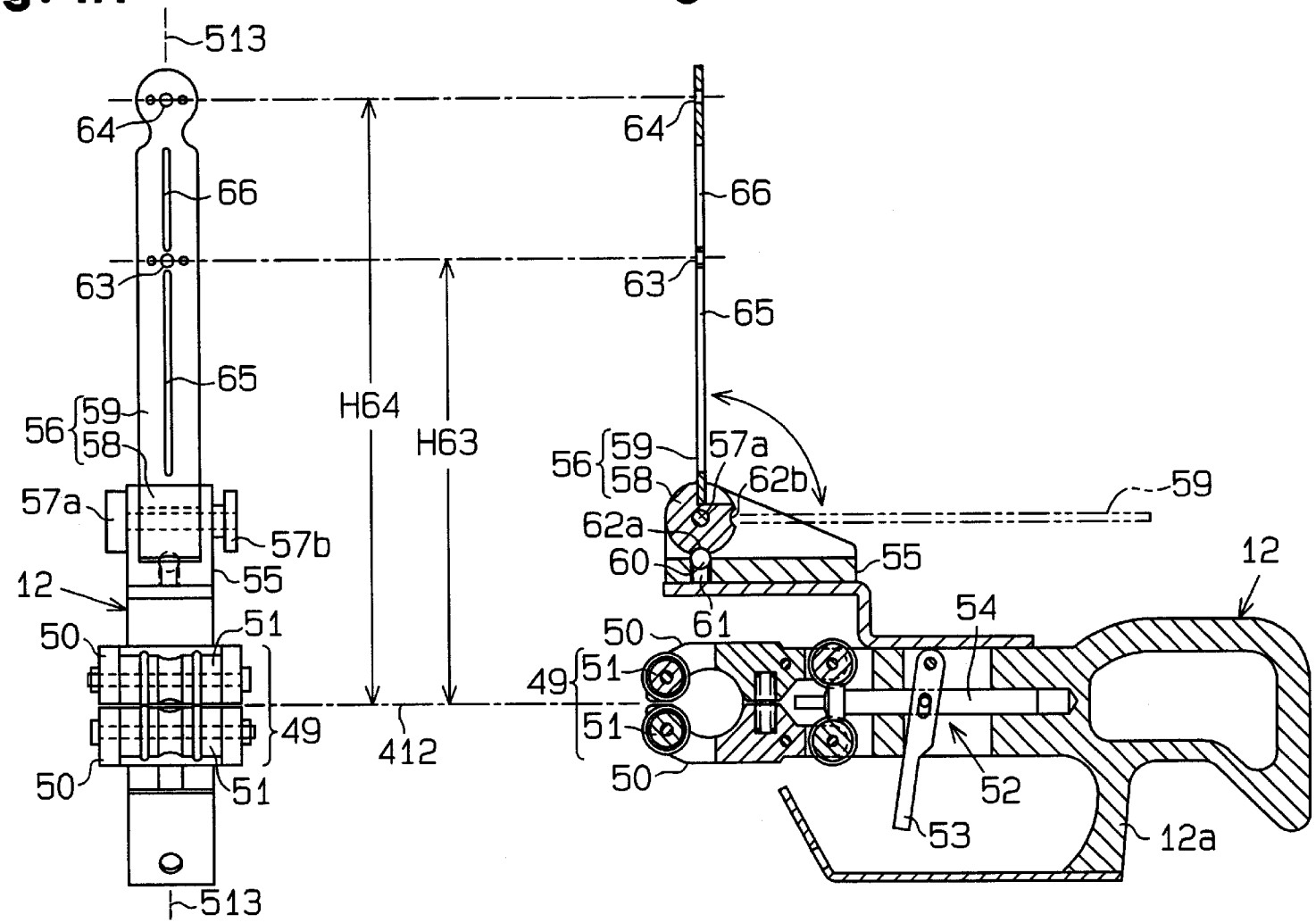
FIG. 4A is a front view of a releaser taken from line 4A—4A of FIG. 1.
FIG. 4B is a cross-sectional view of the releaser of FIG. 4A.

FIG. 4A is a front view of the releaser 12, and FIG. 4B is a cross-sectional view of the releaser 12. The releaser 12 includes a grip 12*a* and a clamp 49, which holds the pellet pouch 14. The clamp 49 has two arms 50, which are selectively arranged between an opened position and a closed position. Opposing holding rollers 51 are arranged on the distal ends of the two arms 50. The holding rollers 51 are rotatable. A clamp drive mechanism 52 opens and closes the arms 50. More specifically, the clamp drive mechanism 52 includes a trigger 53 and a slider 54. The slider 54 slides when the user operates the trigger 53. When the slider 54 is located at a front position, the basal ends of the upper and lower arms 50 are arranged close to each other. This closes the arms 50. When the slider 54 is located at a rear position, the basal ends of the upper and lower arms 50 are separated from each other. This opens the arms 50.

A rear sight 56 is attached to the releaser 12 by means of a bracket 55. The rear sight 56 includes a rear sight plate 59 and a holding base 58, which supports the rear sight plate 59. A pin 57*a* pivotally supports the holding base 58. A spherical body 60 and a compression coil spring 61, which biases the spherical body 60 in an upward direction, are arranged in the bracket 55. Two recesses 62*a*, 62*b* are formed in the holding base 58. When the rear sight plate 59 is held upright, the spherical body 60 engages the recess 62*a*. When the rear sight plate 59 is folded, the spherical body 60 engages the recess 62*b*. The position of the rear sight plate 59 is determined by fastening the pin 57*a* with a nut 57*b*.

The rear sight plate 59 includes two apertures, or upper and lower sight points 63, 64. More specifically, the lower sight point 63 is separated by distance H63 from a plane of contact between the two rollers 51, and the upper sight point 64 is separated by distance H64 from the plane of contact between the two rollers 51. A lower vertical reference line, or lower sight slit 65, extends in the longitudinal direction of the rear sight plate 59 along a line connecting the clamp 49 and the lower sight point 63. An upper vertical reference line, or upper sight slit 66, extends along a line connecting the lower sight point 63 and the upper sight point 65.

Figures 8A, 8B:
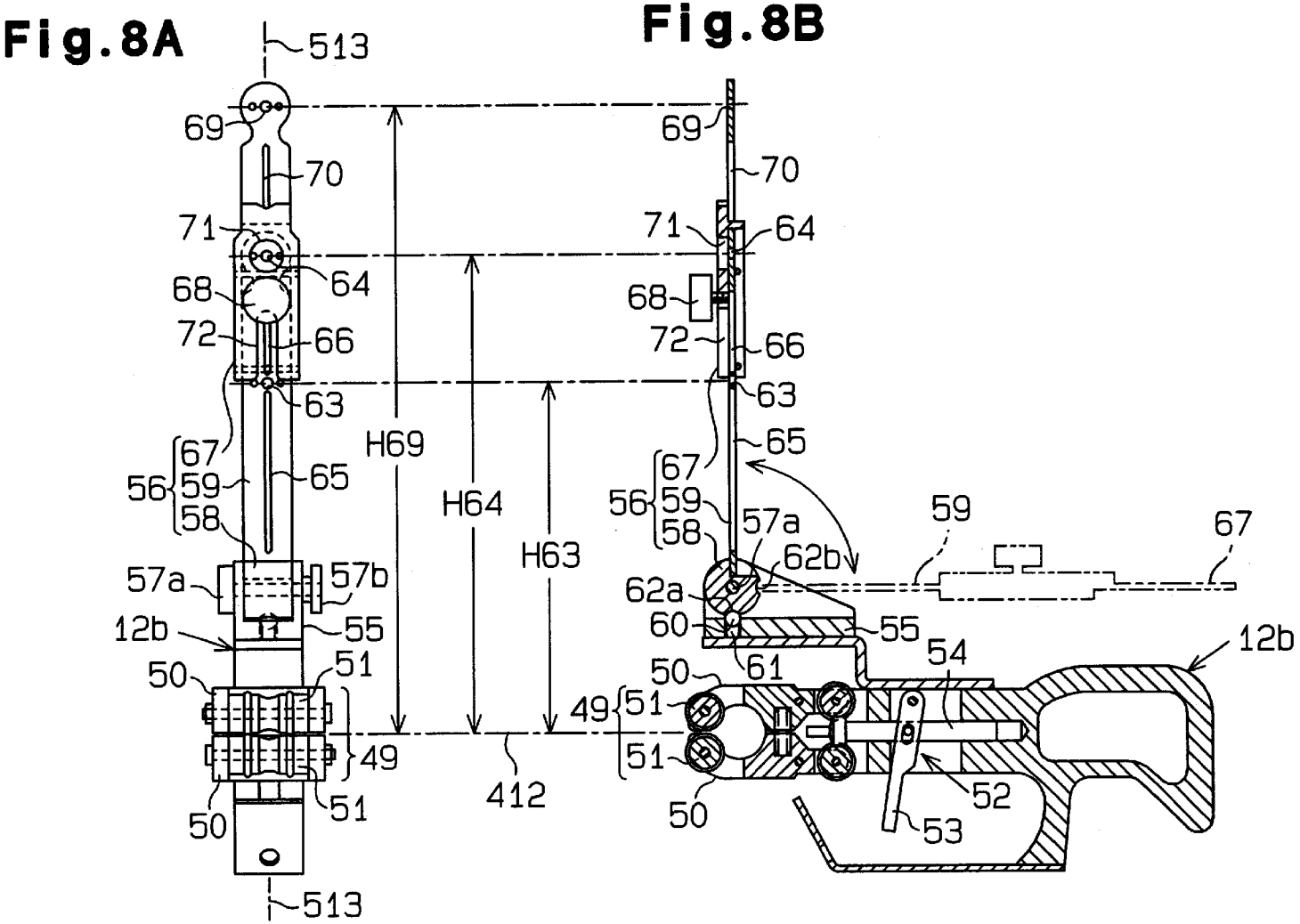
FIG. 8A is a front view showing a further example of a releaser.
FIG. 8B is a cross-sectional view of the releaser of FIG. 8A.

FIGS. 8A and 8B show a further example of the releaser 12*b*. The releaser 12*b* includes a movable rear sight plate 67, which is removable. The structure of the releaser 12*b* is the same as that of the releaser 12 of FIG. 4 except for the movable rear sight plate 67. The movable rear sight plate 67 is movable along the upper sight slit 66 of the rear sight plate 59. A fastening screw 68 fastens the movable rear sight plate 67 to the rear sight plate 59. The movable rear sight plate 67 has a movable sight point 69 and a movable vertical reference line, or movable sight slit 70, extending along a line that connects the movable sight point 69 and the fastening screw 68. The movable sight point 69 and the movable sight slit 70 are used to take aim at a target. The distance H69 between the plane of contact between the rollers 51 and the movable sight point 69 is adjusted by moving the movable rear sight plate 67 along the rear sight plate 59. The movable rear sight plate 67 has a round window 71, through which the upper sight point 64 of the rear sight plate 59 is exposed, and a slit, or elongated window 72, through which the upper sight slit 66 and the lower sight point 63 are exposed.

Figure 5:
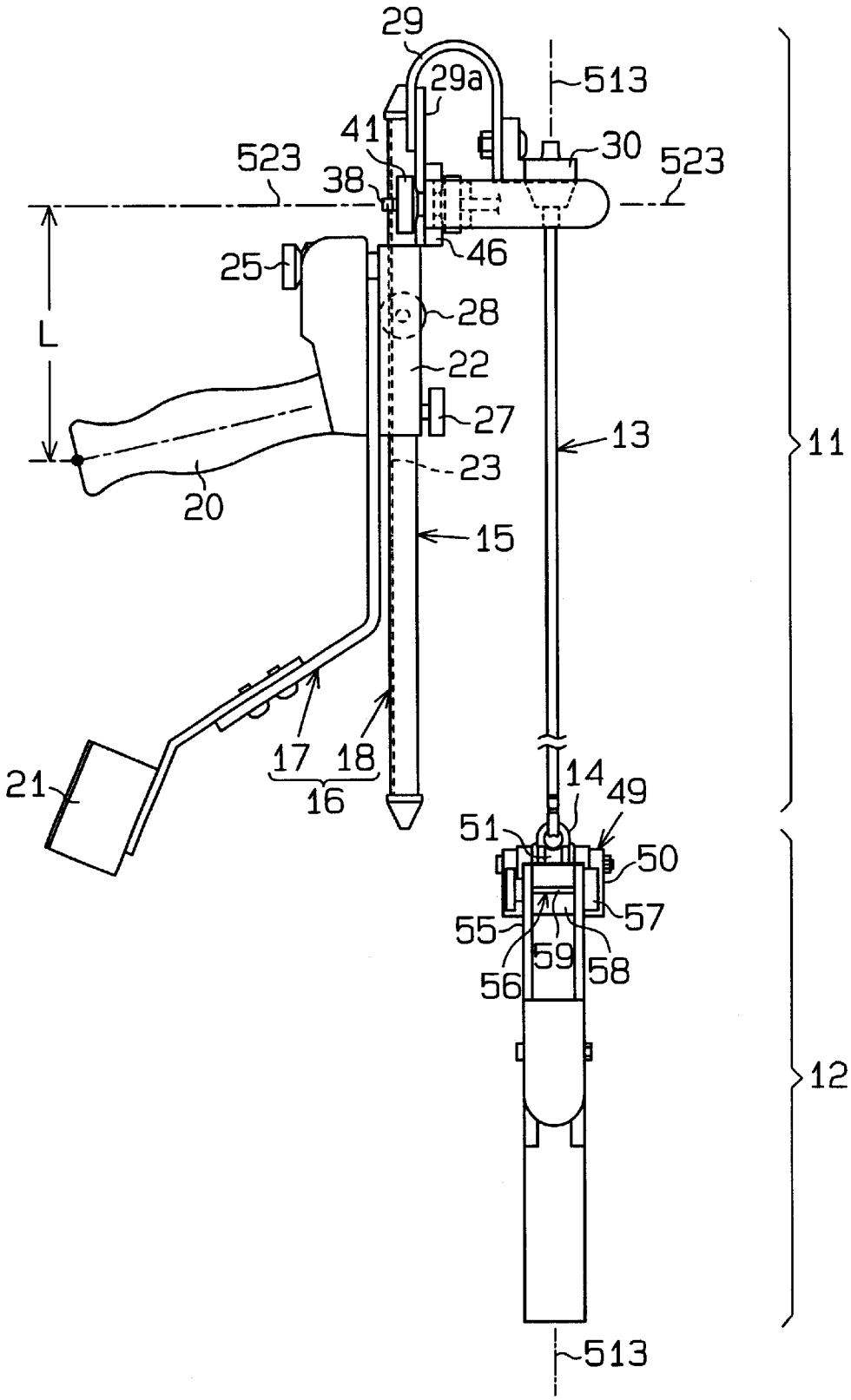
FIG. 5 is a plan view showing the slingshot device of FIG. 1 in a state set for a right-handed user.

The procedure for using the releaser-incorporated slingshot device 10 will now be discussed. FIGS. 1, 2, and 5 show an example of the releaser-incorporated slingshot device 10, which is used by a right-handed user.

The clamp 49 of the releaser 12 or 12*b* is first opened. The pellet 73 is enveloped in the pellet pouch 14. The pellet pouch 14 is then arranged in the clamp 49 and the clamp 49 is closed. This fixes the pellet 73 to the releaser 12 or 12*b*. The user grips the handgrip 20 of the slingshot 11 so that the front sight 39 is faced upward and his or her arm rests in the armrest 21. Further, the user grips the grip 12*a* of the releaser 12 or 12*b* with his or her right hand. Then, the user draws and stretches the elastic band 13. The user inclines the slingshot 11 upward or downward to determine the angle of the slingshot 11 with respect to a reference plane 412 (i.e., shooting angle θ, refer to FIG. 2) in accordance with the height of and distance to the target. The user also uses the level 43 and corrects the holding position of the slingshot 11 so that a vertical reference plane 513 of the slingshot 11 is vertical. The user aligns the sight points 63, 64, or 69 of the rear sight 56 with the sight point 42 of the front sight 39 on the slingshot 11 to take aim at a target along sight line I63, I64, or I69. Further, the user adjusts the position of the releaser 12 so that elastic band 13 may be seen through the sight slits 65, 66, 70 of the rear sight 56. That is, the user adjusts the position of the releaser 12 so that the pellet 73 is arranged along the vertical reference plane 513. When the user operates the trigger 53 and opens the clamp 49, the elastic force of the elastic band 13 shoots the pellet 73 through the shooting space 31.

The preferred embodiment may be modified as described below.

Figure 9:
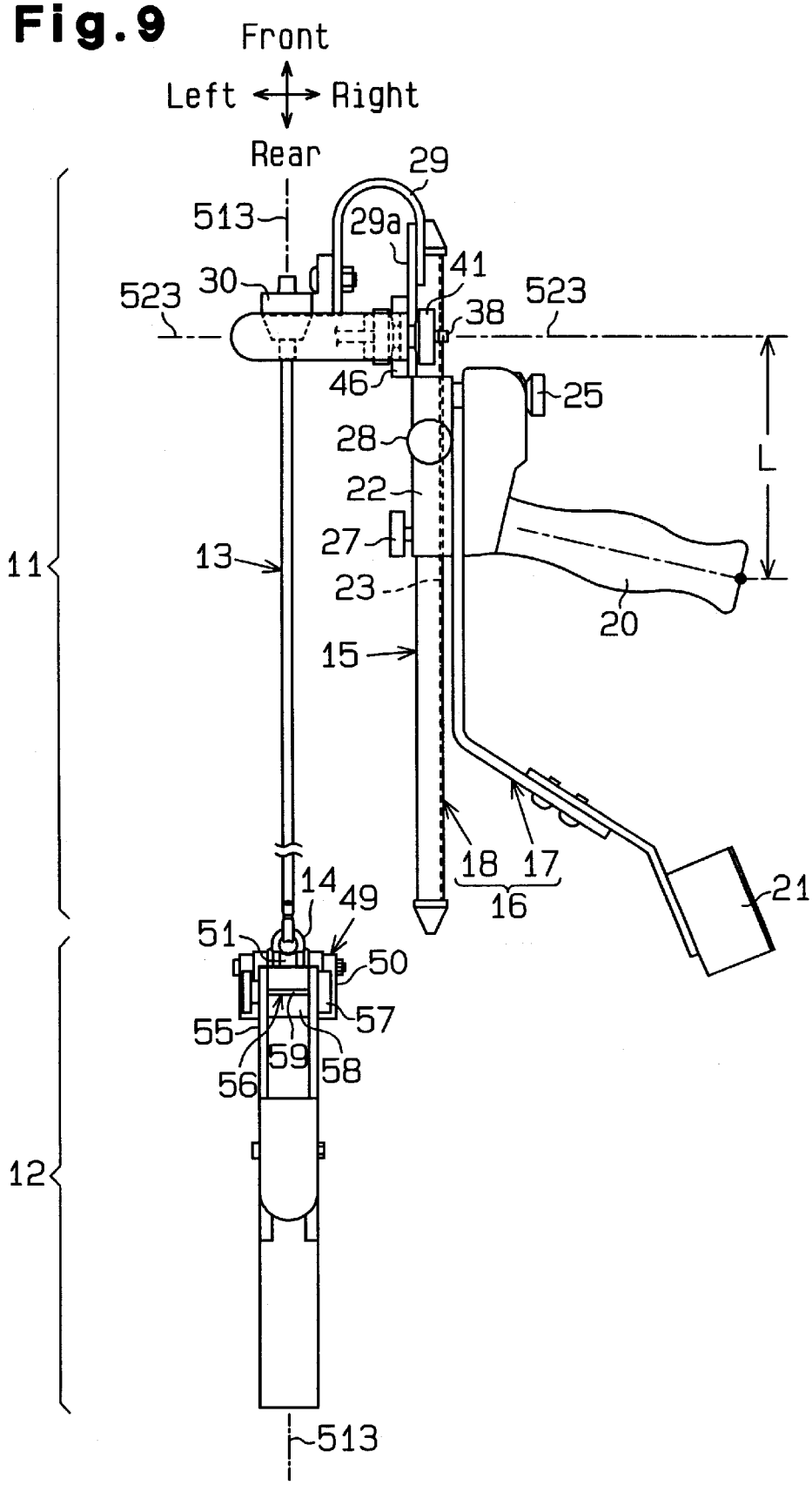
FIG. 9 is a plan view showing the slingshot device of FIG. 1 in a state set for a left-handed user.

FIG. 9 shows an example of the releaser-incorporated slingshot 11 used by a left-handed user. In this case, the slingshot 11 is set so that the handgrip 20 extends from the right side of the slingshot 11. The user loosens the positioning screw 48 to remove the front sight base 19 from the guide sleeve 46. Then, the user turns the slingshot 11 upside down and reattaches the front sight base 19 to the guide sleeve 46 so that the front sight 39 is faced upward. The user holds the handgrip 20 with his or her right hand and holds the releaser 12 or 12*b* with the other hand. The left-hand slingshot 11 is otherwise used in the same manner as the right-hand slingshot 11.

The level 43 of the front sight 39 does not have to be used to change the angle of the slingshot 11 with respect to the horizontal reference plane 412. Accordingly, the level 43 may be eliminated.

The pellet 73 may be shot using only the slingshot 11.

The front sight base 19 may have an additional front sight 39 located under the lower anchor connector 30 along a line connecting the anchor connectors 30. This enables the slingshot 11 to be used by both right-handed and left-handed users without having to remove the front sight base 19. In this case, the two front sights 39 may both be removable from the front sight base 19.

The user may hold the slingshot 11 so that the handgrip 20 is located at a position lower than the support frame 18. In other words, the slingshot 11 may be held so that the two anchor connectors 30 are arranged horizontally. In such a case, it is preferred that the front sight 39 be attached to the front sight base 19 above the shooting space 31 defined between the two anchor connectors 30.

The preferred embodiment has the advantages described below.

The front sight 39 of the slingshot 11 improves the target hitting rate.

The front sight 39 includes the sight point 42 and the level 43. The level 43 is useful for preventing the slingshot 11 from being held in a tilted manner. The user uses the level 43 to correctly hold the slingshot 11 and uses the sight point 42 to shoot the pellet 73 at a target. This further improves the target hitting rate of the slingshot 11.

The front sight 39 is movable along a plane 523, which is perpendicular to the shooting direction of the pellet 73 (forward direction). In other words, the height and horizontal position of the front sight 39 is adjustable. Accordingly, the front sight 39 is positioned at the optimal location in accordance with the user. This facilitates aiming for various users and improves the target hitting rate of the slingshot 11.

The front sight 39 is located near the anchor connectors 30 and outside the shooting space 31. More specifically, the front sight 39 is arranged along a line connecting the two anchor connectors 30 and above the upper anchor connector 30. Since the front sight 39 is located outside the shooting path of the pellet 73, the pellet 73 is shot smoothly without being interfered by the front sight 39.

The front sight base 19 may be removed from the support frame 18. Thus, the front sight 39 may be arranged at an optimal position regardless of with which hand the user holds the slingshot 11. Accordingly, the slingshot 11 is easy to use.

The slingshot 11 is provided with the handgrip 20 and the armrest 21. This enables the user to securely grip the slingshot 11.

The distance L between the handgrip 20 and the two anchor connectors 30 is adjustable. Thus, the drawing length of the elastic band 13 can be adjusted. For example, when shooting a far target, the distance L is increased. When shooting a relatively near target, the distance L is decreased. Further, the slingshot 11 may be held properly regardless of the user's build.

Each anchor connector 30 has the rear opening 33, the diameter of which is smaller than the ball 37, and the front opening 34, the diameter of which is larger than the ball 37. When the elastic band 13 is stretched toward the rear, each end 13*a* of the elastic band 13 engages the conical surface 35*a* of the corresponding anchor connector 30. This prevents the ends 13*a* of the elastic band 13 from falling out of the rear openings 33.

The relatively thick portions of the elastic band 13 come into contact with the rear openings 33. This prevents the elastic body 13 from tearing and rigidly connects the elastic band 13 to the anchor connectors 30.

Part of the elastic band 13 is exposed from the front openings 34. This facilitates the replacement of the elastic band 13. The slit 36 extends through the wall of each anchor connector 30 to connect the rear opening 33 and the front opening 34. This facilitates the attachment and replacement of the elastic band 13.

The releasers 12, 12*b* are each provided with the clamp 49, which holds the pellet 73, and the rear sight 56. The rear sight 56 increases the target hitting rate of the slingshot device 10.

The rear sight 56 includes the sight points 63, 64, 69, which are used when taking aim, and sight slits 65, 66, 70, which are used to adjust the drawing direction of the elastic band 13. The elastic band 13 is drawn in a manner that the elastic band 13 is seen through the sight slits 65, 66, 70. This properly draws the elastic band 13 in a direction opposite the shooting direction. As a result, the target hitting rate of the slingshot device 10 is improved.

The rear sight 56 has the sight points 63, 64, 69. The optimal one of the sight points 63, 64, 69 is selected in accordance with the target position, the shooting angle θ, and the user. Thus, the slingshot 11 is held at the optimal position when shooting the pellet 73. Accordingly, the target hitting rate of the slingshot device 10 is improved.

As shown in FIG. 3A, the handgrip 20 is arranged between the two anchor brackets 29 (anchor connectors 30). Accordingly, the slingshot 11 is held in a stable manner when the elastic band 13 is drawn.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; and a front sight attached to the main body near one of the first and second connecting elements and located outside the shooting space.

2. The slingshot according to claim 1, wherein the front sight is arranged along a line connecting the first and second connecting elements.

3. The slingshot according to claim 1, wherein the first and second connecting elements have a slit for facilitating the attachment of the elastic band to the first and second connecting elements.

4. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; and a front sight attached to the main body selectively at a first position, which is close to the first connecting element, and a second position, which is close to the second connecting element.

5. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; and a front sight attached to the main body near one of the first and second connecting elements, wherein the front sight includes a sight point, which is used to take aim, and a level.

6. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; and a front sight attached to the main body near one of the first and second connecting elements, wherein the position of the front sight is adjustable along a plane that is perpendicular to the shooting direction of the pellet.

7. The slingshot according to claim 6, wherein the main body includes:

a support frame for supporting the first and second connecting elements; and a front sight base movably attached to the support frame to support the front sight, wherein the front sight base is supported by the support frame so that the front sight base is movable in a direction parallel to a line connecting the first and second connecting elements, and the front sight is supported by the front sight base so that the front sight movable in a direction intersecting the line connecting the first and second connecting elements.

8. The slingshot according to claim 7, further comprising:

an arm brace attached to the support frame, wherein the arm brace includes a handgrip, and the arm brace is movable in a direction perpendicular to the moving direction of the front sight base.

9. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; wherein each of the first and second connecting elements is hollow and has a first opening, which is opened in the shooting direction of the pellet, a second opening, which is opened in a direction opposite to the shooting direction of the pellet, and an engaging surface, which is defined between the first and second openings, and wherein the elastic band extends through the second opening and is held by the engaging surface; and a front sight attached to the main body near one of the first and second connecting elements.

10. The slingshot according to claim 9, wherein the elastic band is an elastic tube having two ends with a ball being held in each of the ends, the first opening has a diameter that is greater than the diameter of the ball, the second opening has a diameter that is smaller than the diameter of the ball, and the engaging surface is conical.

11. A releaser of a slingshot, wherein the slingshot includes an elastic band, which is used to shoot a pellet, and a pouch, which is connected to the elastic band, the releaser comprising:

a clamp for holding the pouch, wherein the clamp is selectively arranged at a closed position, in which the clamp holds the pouch, and an opened position, in which the clamp releases the pouch; and a rear sight arranged near the clamp, wherein the rear sight includes a sight point used when taking aim and a sight slit used to adjust a direction in which the elastic band is drawn.

12. The releaser according to claim 11, wherein the sight point is one of a plurality of sight points, each sight point separated by a different distance from the clamp.

13. The releaser according to claim 11, wherein the sight point is movable and the distance between the sight point and the clamp is adjustable.

14. A slingshot device comprising:

a slingshot including:

a main body;

an elastic band having two ends and connected to the main body to shoot a pellet;

a pouch connected to the elastic band;

first and second connecting elements for connecting the two ends of the elastic band to the main body, wherein the first and second connecting elements are separated from each other on the main body, and the pellet is shot through a shooting space defined between the first and second connecting elements; and a front sight attached to the main body near one of the first and second connecting elements and located outside the shooting space; and a releaser for stretching the elastic band, wherein the releaser includes:

a clamp for holding the pouch, wherein the clamp is selectively arranged at a closed position, in which the clamp holds the pouch, and an opened position, in which the clamp releases the pouch; and a rear sight arranged near the clamp.

15. A slingshot including an elastic band, which is used to shoot a pellet and has two ends, and a pouch, which is connected to the elastic band, the slingshot comprising:

a frame extending in a direction the pellet is shot;

a front sight base attached to the frame, wherein the front sight base is movable in a first direction, which is perpendicular to the frame;

a front sight attached to the front sight base, wherein the front sight is movable to a second direction, which is perpendicular to the frame and to the first direction;

two brackets fixed to the frame, wherein each of the two brackets supports one of the two ends of the elastic band, and wherein the two brackets are separated from each other in the first direction;

first and second connecting elements each fixed to one of the two brackets, wherein the first and second connecting elements connect the ends of the elastic band to the two brackets; and a handgrip attached to the frame, wherein the handgrip is moved along the frame to change the distance from the handgrip to the first and second connecting elements.

16. The slingshot according to claim 15, wherein the elastic band is an elastic tube having two ends with a ball being held in each of the ends, wherein each of the first and second connecting elements is hollow and has a front opening, which is opened in the shooting direction of the pellet and has a diameter that is larger than that of the associated ball, a rear opening, which is opened in a direction opposite to the shooting direction of the pellet and has a diameter that is smaller than that of the associated ball, and a conical surface, which defines the rear opening.

17. The slingshot according to claim 16, wherein the elastic band is extended through the rear opening of each connecting element and held between the corresponding conical surface and ball.

18. The slingshot according to claim 15, wherein the front sight base is removable from the frame and may be selectively arranged at a first position, which is close to the first connecting element, and a second position, which is close to the second connecting element.

19. A slingshot including an elastic band, which is used to shoot a pellet and has two ends, and a pouch, which is connected to the elastic band, the slingshot comprising:

a main body;

first and second connecting elements for connecting the two ends of the elastic band to the main body, wherein the first and second connecting elements are separated from each other on the main body, and the pellet is shot through a shooting space defined between the first and second connecting elements; and an adjustable front sight attached to the main body and located outside the shooting space.

20. A releaser of a slingshot, wherein the slingshot includes an elastic band, which is used to shoot a pellet, and a pouch, which is connected to the elastic band, and wherein the releaser is a separate member of the slingshot and, the releaser comprising:

a clamp for holding the pouch, wherein the clamp is selectively arranged at a closed position, in which the clamp holds the pouch, and an opened position, in which the clamp releases the pouch; and a rear sight arranged near the clamp, wherein the rear sight is foldable.

* * * * *